United States Patent [19]

Schudy et al.

[11] 3,977,799

[45] Aug. 31, 1976

[54] FILING DEVICE FOR PAPERS

[75] Inventors: Karl-Heinz Schudy, Espelkamp; Heinz Kleinert, Lubbecke, both of Germany

[73] Assignee: Robert Krause KG, Espelkamp, Germany

[22] Filed: Mar. 10, 1975

[21] Appl. No.: 557,203

[30] Foreign Application Priority Data

Jan. 11, 1975 Germany ..... 2500918

[52] U.S. Cl. ..... 402/4; 402/48; 312/184

[51] Int. Cl.[2] ..... B42F 3/00; B42D 17/00

[58] Field of Search ..... 402/4, 48; 281/15 A; 312/184

[56] References Cited

FOREIGN PATENTS OR APPLICATIONS

| | | | |
|---|---|---|---|
| 35,470 | 12/1965 | Finland | 402/4 |
| 562,298 | 10/1932 | Germany | 402/4 |

*Primary Examiner*—Jerome Schnall
*Attorney, Agent, or Firm*—Frank J. Jordan

[57] ABSTRACT

A file has a pin-type document binding mechanism formed by two co-operating binding elements which can be united to close and lock the binding and so secure documents therein, and the binding has two captive, slideable brackets which can be pulled apart until they protrude from either end of the spine of the file to enable the file to be suspended spine-uppermost between rails of a file suspension system.

5 Claims, 2 Drawing Figures

FILING DEVICE FOR PAPERS

PRIOR APPLICATION

Figure 1:
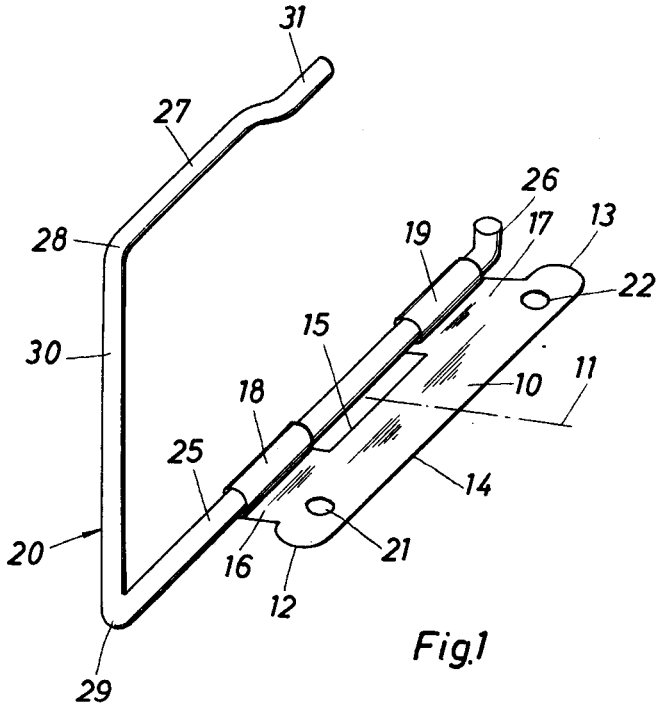

Priority, Federal Republic of Germany, Jan. 11, 1975 Application No. P 25 00 918.1.

The present invention relates to a filing device for papers.

More particularly, the invention relates to a filing device for punched or perforated documentation, in which a lockable pin mechanism has filing elements onto which punched documents are placed. The filing elements are attached to one side of a carrier rail which can be secured to a back cover section of a file along and beside the spine of the file; the pin mechanism can be secured to a front cover section of the file such that when the mechanism is locked, it secures the back cover section to the front cover section.

Filing devices of this kind generally have their carrier rails riveted to the back cover section of the file, the carrier rails being made of a metal punching or stamping which supports a plurality of small filing tubes which are riveted in position, the tubes constituting the said filing elements. Release levers with corresponding pins and closing mechanisms by means of which the release levers can be locked to the front cover sections complete the filing devices. The file cover sections generally exhibit intermediate portions adjoining the spine at either side thereof. The intermediate portions are separated from their associated cover sections and hinge by creases and the intermediate portions carry the components of the filing devices. Files equipped with filing devices of this kind are stored either in a laid-flat attitude or a standing attitude e.g. on shelves.

The principal object of the present invention is so to adapt a filing device of the kind described above that a file or the like to which it is fitted can be stored in a hanging attitude with the spine facing upwards, without complicating the design of the filing device, and without substantially increasing costs, material used and manufacturing operations involved in producing the file device.

According to the present invention, there is provided a filing device for perforated documentation, comprising a pin-type binder for attachment to a file cover or the like, the device having filing elements attached to one side to a carrier rail to co-operate with a closing pin mechanism, the carrier and pin mechanism being so arranged that, when secured to the back and front covers adjacent the spine of the file, closure of the pin mechanism locks the back cover to the front cover, the device further including a pair of suspension brackets pivotally mounted alongside the carrier rail for pivoting about an axis parallel to the rail and to a neighbouring spine crease when the device is attached to a file cover the pivotal mounting of the brackets also allowing the brackets to be moved towards and away from one another along the axis.

The device should be mounted in a file cover such that when the brackets are moved towards one another they do not project, and when moved away from one another they do project from the file cover so as to allow the file to be hung thereon spine-uppermost from a suspension rail system.

A filing device embodying the invention provides an extremely simple facility for suspension of the file on carriers provided for this kind of storage, yet the suspension brackets in no way impede the use and storage of the file in a coventional standing attitude. When the file is open, the brackets can also be pivoted towards the spine so that the filing elements are freely accessible for the filing and removal of perforated documentation. Advantageously, the bracket mountings comprise one or a pair of guides constituted by a flat sheet metal punching with at least one bearing bush for each bracket, the bushes being formed by rolled-over edge zones of the punching. This kind of guide meets all the requirements of fast and cheap mass production in a particularly effective way.

One such guide punching may be given for each bracket; alternatively, a single punching could be constructed to guide both brackets.

If desired, the guides/bracket mountings could be formed as an integral part of the carrier rail. The preferred guide and the carrier rail can have registering apertures to allow them both to be rivetted or otherwise fastened together and to the back cover section. This does away with the need for additional attachment means and for special operations to assemble the filing mechanism in a file cover.

The suspension bracket can consist of round wire bent to a U-shape. The U-shape gives the suspension bracket two support points which, at the interval by which the legs or limbs of the U are spaced apart, ensure stable support of a file on a suspension rail system so that the file hangs down vertically irrespective of the position and quantity of documentation which it contains. The U-shape, open in the inward direction, gives that part of the suspension bracket projecting out of the file, a high torsional stiffness and furthermore forms a smooth external edge preventing catching or snagging whilst the file is being handled. In addition, it can be arranged that the portion of the bracket which, when the file is in the suspended position, projects out of the latter, is bent over at its end in such a fashion that the bracket and file are secured against slipping off the suspension system. A stop to define the extended position of the U-shaped suspension bracket can be created in a particularly simple way by arranging for that leg by which the bracket is mounted to have an inner bent over end. This bend can easily be produced, satisfactorily performs the stop function and at the same time captively secures bracket to the pivotal mounting.

Again, it can be arranged for the free leg of the suspension bracket to be cranked at its end zone. Such a formation reduces the freedom of motion of the free leg between the interior of the spine section and the pin mechanism and confers upon the bracket a predetermined position in the file.

Figure 2:
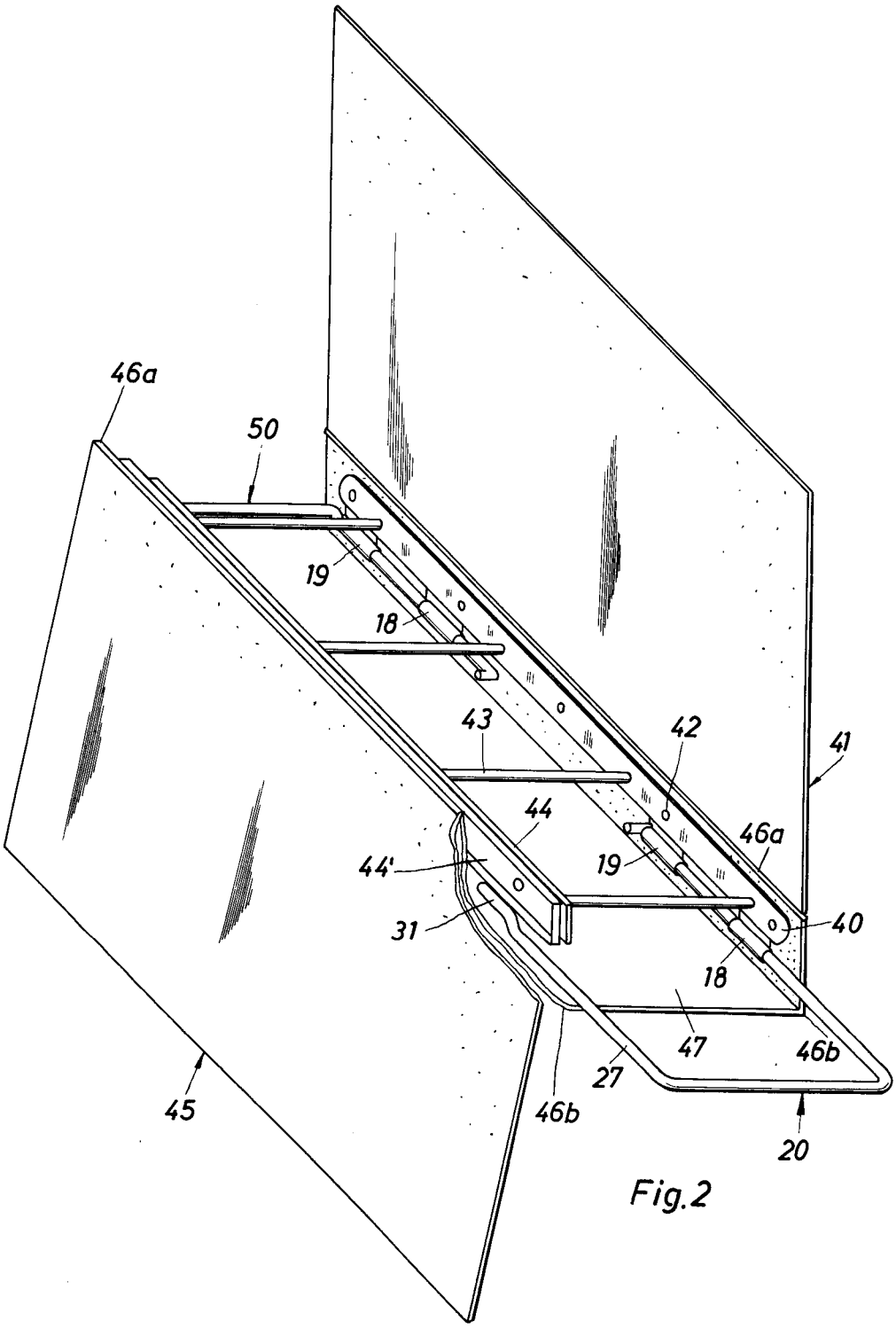

The invention will now be described in more detail by way of example only with reference to the accompanying drawings, in which:

FIG. 1 illustrates a guide and suspension bracket of a filing device in accordance with the invention, and FIG. 2 illustrates a filing device in accordance with the invention having two guides and suspension brackets as shown in FIG. 1, the device being illustrated in position in a file cover.

FIG. 1 illustrates a single guide 10 and suspension bracket 20 for a filing device which is illustrated in toto in FIG. 2. The guide 10 is symmetrical vis-a-vis a midline 11 and consists of an elongated metal plate component having rounded ends 12, 13. The guide 10 is formed by a stamping or punching operation such that the rounded ends 12 and 13 and the longitudinal edges 14, 15, can be located flush with the edges of a carrier rail, to be described in connection with FIG. 2. The guide 10 has two laterally-projecting sheet metal lugs 16 and 17 which are rolled over to form aligned bearing bushes 18, 19 for the suspension bracket 20. The bushes are spaced apart so that they can transmit relatively large couples acting perpendicularly to their axis. There are two rivet holes 21 and 22 in the neighbourhood of the rounded portions 12 and 13 and the rivet holes are matched in terms of spacing and diameter to rivet holes in the carrier rail.

The suspension bracket 20 is substantialy U-shaped and has two limbs or legs of dissimilar length. The longer leg 25 is straight over virtually its whole length and is pivotally housed in the bearing bushes 18 and 19. The bracket 20 can also be displaced longitudinally relative to the guide 10, in the bushes. Leg 25 has a terminal portion 26 bent substantially at right angles to the remainder of the leg to form a limit stop preventing detachment of the suspension bracket 20 from the guide 10. The opposite leg 27 is connected to leg 25 through two bent portions 28 and 29 and a base 30, which in this example is straight. The leg 27 is straight for most of its length following the bend 28, but has a cranked portion 31 which results in the axis of a terminal portion of the leg to be offset from the plane defined by the rest of the bracket.

FIG. 2 illustrates two guides and their suspension brackets fitted to a filing device of the pin kind. Each guide 10, of which only the bushes 18 and 19 are visible, is riveted in position between a carrier rail 40 belonging to the filing device and a back cover section 41 of a file cover. The edges 12,13,14,15 of the guides 10 are flush with the superposed edges of the carrier rail 40 so that no projections remain which could catch or snag on papers or the user's fingers.

The carrier rail 40 is attached by rivets 42 to the back cover section 41 and carries for example four filing elements comprising tubes 43. Pins (not visible) on a release rail 44 enable documentation filed on the tubes 43 to be secured in place. The release rail 44 is a detachable item but can be locked to the front cover section 45 by means of a locking box 44' which is attached to the front cover section. When so locked the filing device secures the front and rear cover sections together. The cover zones attached to the carrier rail 40 and the locking member 44' here constitute intermediate sections which are separated from the cover sections 41, 45 and from the spine section 47, in each case by two creases *6a, 46b* so that even with the filing device locked closed, the file can be opened and any documentation which it contains inspected.

The substantially identical suspension brackets, which are marked 20 and 50, are located in the bearing bushes 18 and 19 of the two guides attached beneath the ends of the carrier rail 40, and each points outwards away from the other. Their cranked portions 31 bear against the release rail 44 so that their legs 27, which bear against the inside of the spine section 47 also are supported substantially without any backlash. The suspension bracket 50 is distinguished from that 20 simply by the direction (not shown) of the cranked formation which, in the case of bracket 50 points towards the other side because of the mirror-symmetrical disposition of the brackets in relation to one another.

Both brackets 20, 50 can be moved inwardly and outwardly in their bearing bushes 18 and 19. When pushed in, as shown by bracket 50, they cease to project beyond the external edge of the spine section

47, thus enabling the file to be stood upright in the conventional way. When pulled out, the suspension brackets 20 and 50 enable the file to be suspended from hangers such as rails or the like.

To file perforated documentation, after releasing the locking member 44' the spine section 47 can be folded or hined so as to lie in the same plane as the back cover section 41. The suspension brackets 20 and 50 can then be swung away from the ends of the filing elements 43 to rest on the spine section 47. Removal of the cover rail 44, whose pins form a release yoke, finally make the free ends of the filing tubes 43 freely accessible.

We claim:

1. A filing device for perforated papers comprising a spine, a first cover pivoted to said spine at a first pivotal connection, a second cover pivoted to said spine at a second pivotal connection, said spine having terminating ends, a carrier rail secured to said first cover at a position spaced from said first pivotal connection, locking means secured to said second cover at a position spaced from said second pivotal connection, filing elements for releasably holding perforated papers secured to said carrier rail and extending to said locking means, said locking means being operable to selectively engage or release said filing elements, whereby in said engaged position said locking means engages and holds said filing elements to thereby secure said locking means, said filing elements, said carrier rail, and said covers in a fixed position relative to one another and to prevent removal of perforated papers from said filing elements in said filing device and in aid release position said filing elements are released from said locking means to provide for removal or placement of papers on said filing elements, a pair of suspension members each having a generally U-shaped configuration having a pair of leg elements, one of said leg elements being disposed between said first pivotal connection and said carrier rail, the other of said leg elements being disposed between said second pivotal connection and said locking means, and mounting brackets each having a flat portion secured to said carrier rail between the latter and said first cover and having a support portion for slidably and pivotably supporting one of said leg elements of said U-shaped suspension members, said suspension members being longitudinally slidable on said mounting brackets between extended positions in which said suspension members extend beyond said terminating ends of said spine to permit said filing device to be suspended with its spine uppermost from a suspension rail system or the like and a retractable position in which said suspension members are disposed contiguous or inwardly of said terminating ends of said spine, said suspension members being pivotal on said mounting brackets whereby upon release of said locking means, said filing elements are released from said locking means such that said filing elements, said carrier rail, said mounting brackets and said first cover may be pivoted as a unit about said first pivot axis as said one leg of said suspension member pivots relative to said support portion of said mounting bracket to thereby facilitate access to said filing elements and said papers.

2. A filing device according to claim 1 wherein said support portion of said mounting brackets comprises bushings, said one leg element of said suspension member being slidably and rotatably disposed in said bushings.

3. A filing device according to claim 2 wherein said bushings are disposed in the space between said first pivotal connection and said carrier rail.

4. A filing device according to claim 1 wherein the other leg element of said suspension member has an offset portion, said offset portion abutting said locking means, said other leg element abutting said spine such that said other leg element is thereby abuttingly and snugly retained between said locking means and said spine.

5. A filing device according to claim 1 wherein said flat portion of said suspsension member has at least part of its peripheral edges flush with said carrier rail.

* * * * *